US005230209A

United States Patent [19]

Hirai et al.

[11] Patent Number: 5,230,209

[45] Date of Patent: Jul. 27, 1993

[54] METHOD OF CONVEYING PACKAGES FROM DRAW FALSE TWISTING MACHINE

[75] Inventors: Kazuyasu Hirai, Nagaokakyo; Kazuyoshi Suzuki, Ohtsu, both of Japan

[73] Assignee: Murata Kikai Kabushiki Kaisha, Kyoto, Japan

[21] Appl. No.: 883,927

[22] Filed: May 12, 1992

Related U.S. Application Data

[63] Continuation of Ser. No. 581,740, Sep. 13, 1990, abandoned.

[30] Foreign Application Priority Data

| | | | |
|---|---|---|---|
| Sep. 18, 1989 | [JP] | Japan | 1-241424 |
| Sep. 18, 1989 | [JP] | Japan | 1-241425 |
| Oct. 2, 1989 | [JP] | Japan | 1-257595 |
| Oct. 2, 1989 | [JP] | Japan | 1-257596 |

[51] Int. Cl.[5] ..... D01H 13/26; D01H 13/02

[52] U.S. Cl. ..... 57/281; 57/90; 57/291

[58] Field of Search ..... 57/90, 268, 270, 281, 57/284, 290, 291

[56] References Cited

U.S. PATENT DOCUMENTS

| | | | |
|---|---|---|---|
| 3,895,725 | 7/1975 | Mayer | 57/281 X |
| 3,950,928 | 4/1976 | Murakami et al. | 57/291 |
| 4,201,036 | 5/1980 | Schellenberg et al. | 57/290 X |
| 4,454,710 | 6/1984 | Warner et al. | 57/284 X |
| 4,586,326 | 5/1986 | Igel | 57/90 X |
| 4,720,967 | 1/1988 | Güttler | 57/90 X |
| 4,757,679 | 7/1988 | Marzoli | 57/268 X |
| 4,840,022 | 6/1989 | Karl et al. | 57/268 X |
| 4,846,414 | 7/1989 | Rohner et al. | 57/270 X |
| 4,932,201 | 6/1990 | Meroni et al. | 57/281 X |
| 4,979,360 | 12/1990 | Kallmann et al. | 57/281 |

FOREIGN PATENT DOCUMENTS

| | | | |
|---|---|---|---|
| 0311394 | 4/1989 | European Pat. Off. | 57/281 |
| 1-077635 | 3/1989 | Japan | 57/291 |

*Primary Examiner*—Daniel P. Stodola
*Assistant Examiner*—Michael R. Mansen
*Attorney, Agent, or Firm*—Spensley Horn Jubas & Lubitz

[57] ABSTRACT

A package conveyance apparatus wherein the packages are doffed out of the body of the draw false twisting machine by an automatic doffer which is moved between the body and primary heaters, the packages are transferred onto pegs coupled to an endless drive device which is revolved around the primary heaters, the device is then revolved to convey the packages, and pushers push out the packages onto an out-of-the-machine conveying device having trays or pegs.

7 Claims, 9 Drawing Sheets

METHOD OF CONVEYING PACKAGES FROM DRAW FALSE TWISTING MACHINE

This is a continuation of application Ser. No. 07/581,740 filed on Sep. 13, 1990, now abandoned.

FIELD OF THE INVENTION

The present invention relates to a method in which a package of a textured yarn produced by a draw false twisting machine is automatically conveyed to an out-of-the-machine conveying device extending to an inspection and packing chamber or the like.

RELATED ART STATEMENT

There has been known a conventional method of conveying a package from a draw false twisting machine. In the method, the package is doffed from the body of the machine by an automatic doffer movable between a primary heater and the body, is transferred onto a peg stand secured along the primary heater, and is then conveyed to an inspection and packing chamber by a person using a handcart or the like. The method is described with reference to FIGS. 10 and 11 from now on. The whole constitution of the draw false twisting machine for producing the package is first described. As shown in FIG. 10, a yarn 52 fed from a yarn supply package 51 in a creel stand 50 is kept at such tension by a first feed roller 53 and a second feed roller 54 that the yarn can be drawn. A false twisting unit 55 such as a nip twister is provided between the feed rollers 53 and 54 near the feed roller 54 located downstream of the other feed roller 53, and tentatively twists the yarn 52 upstream of the twisting unit. The primary heater 56 for thermally fixing the yarn is provided between the feed rollers 53 and 54 near the feed roller 53 located upstream of the other feed roller 54, and heats the tentatively twisted yarn 52 to a drawing temperature. A third feed roller 57 is provided downstream of the second feed roller 54. A secondary heater 58 is provided between the feed rollers 54 and 57, and reheats the yarn 52. The reheated yarn 52 is finished as the package 60 by a take-up winder 59. Since the primary heater 56 of the draw false twisting machine is tall, the primary heater is disposed separately from the body 61 of the machine, which includes the false twisting unit 55 and more downstream portion of the machine. The primary heater 56 faces the body 61. A path 62 is provided between the primary heater 56 and the body 61 so as to make it easy to engage the yarn 52 and perform maintenance work. The method itself is described with reference to FIG. 11 from now on. The automatic doffer 63 is provided as a package conveyor in the path 62 so that the doffer is movable along the body 61. The peg stand 64 is secured to ground so that the peg stand faces the path side of the primary heater 56. Three pegs 65 projects from the peg stand 64 into the path 62. The automatic doffer 63 transfers the package 60 out of the body 61 onto the peg 65. For that purpose, the doffer 63 holds the package 60 on a bobbin, picks up the package from the take-up winder, changes the direction of the package by an angle of 90 degrees, moves the package to a position opposed to the peg 65, and pushes out the package toward the peg. In other words, in the method, the automatic doffer movable between the primary heater and the body doffs the package 60 out of the body and transfers the package onto the peg 65 of the peg stand 64 so that the operating person manually picks up the package from the peg and carries the package on the handcart or the like to the inspection and packing chamber.

Since the peg stand 64 is secured in the above-mentioned method of conveying the package from the draw false twisting machine, the operating person moves about in the path 62 while pushing the handcart or the like to pick up the package 60 from the peg stand 64. For that reason, there is a problem that it is time-consuming and inefficient to pick up the package 60 from the peg stand 64. The worker is not allowed to hold the package 60 on the surface portion thereof, for the protection of the yarn layer thereof, but must hold the package on the bobbin to pick up the package from the peg 65 and then puts the package on the handcart or the like in such a manner that the bobbin is located on the downside of the package. Such slow, troublesome work is repeated. The work has recently become more efficient, since package size and weight have been increased. Since the yarn is engaged after the package is picked up from the peg, the production efficiency of the machine is lowered if picking up the package is delayed.

OBJECT AND SUMMARY OF THE INVENTION

The present invention was made in consideration of the above-mentioned problem of the prior art. Accordingly, it is an object of the present invention to provide a method of efficiently and automatically conveying packages from a draw false twisting machine.

In the package conveyance method provided in accordance with the present invention, the packages are doffed out of the body of the draw false twisting machine by an automatic doffer which is moved between the body and primary heaters, the packages are transferred onto pegs coupled to an endless drive means which is revolved around the primary heaters, the means is then revolved to convey the packages, and pushers push out the packages onto an out-of-the-machine conveying device having trays or pegs.

The step in which the packages are conveyed with the pegs coupled to the endless drive means, which is revolved around the primary heaters, and the step in which the packages are pushed out of the conveyance are kinematically connected with each other. For that reason, the packages are efficiently delivered onto the out-of-the-machine conveying device.

DETAILED DESCRIPTION OF PREFERRED EMBODIMENT

Figure 1:
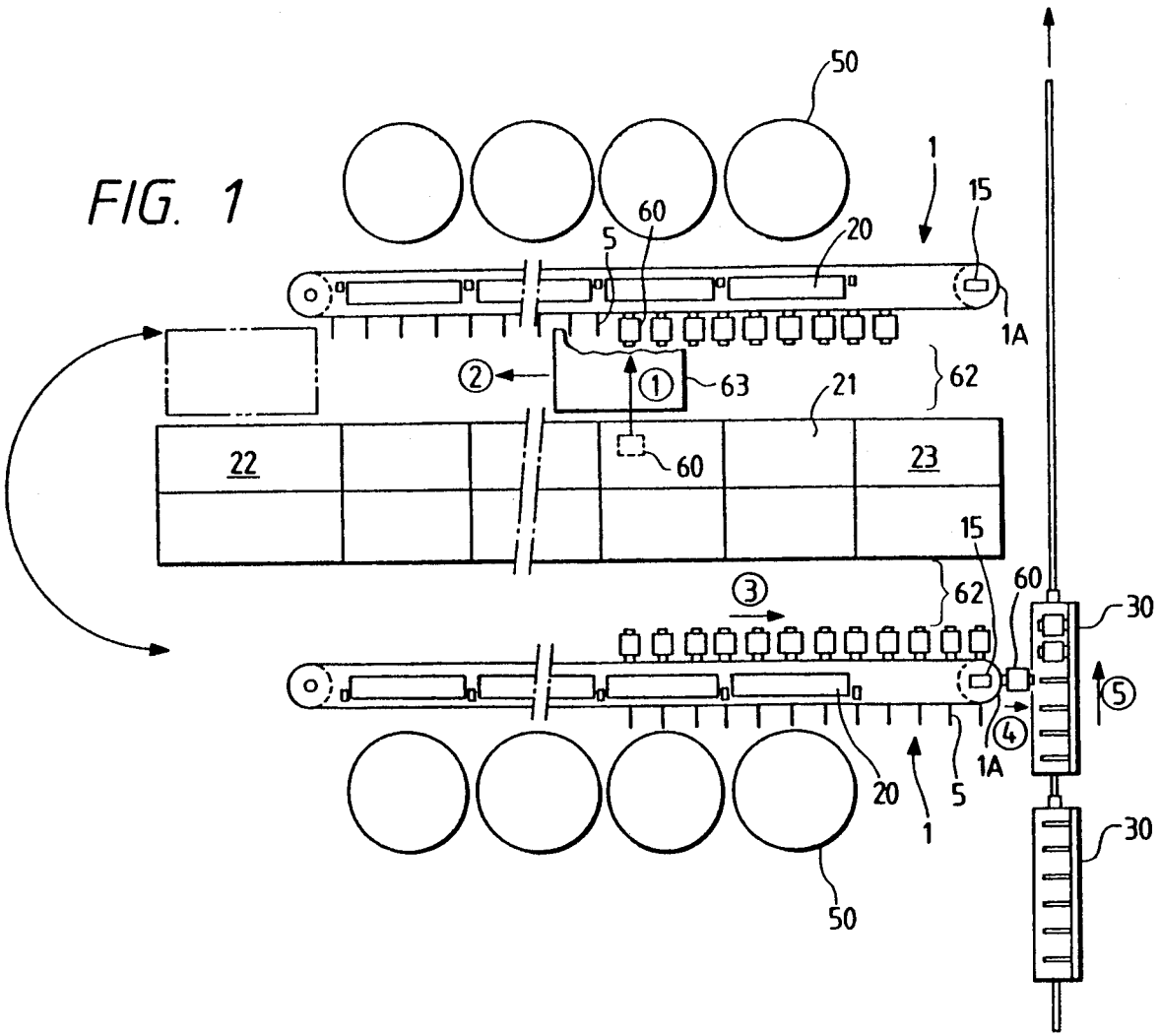
FIG. 1 is a plan view for describing a method of conveying a package from a draw false twisting machine.
Figure 2:
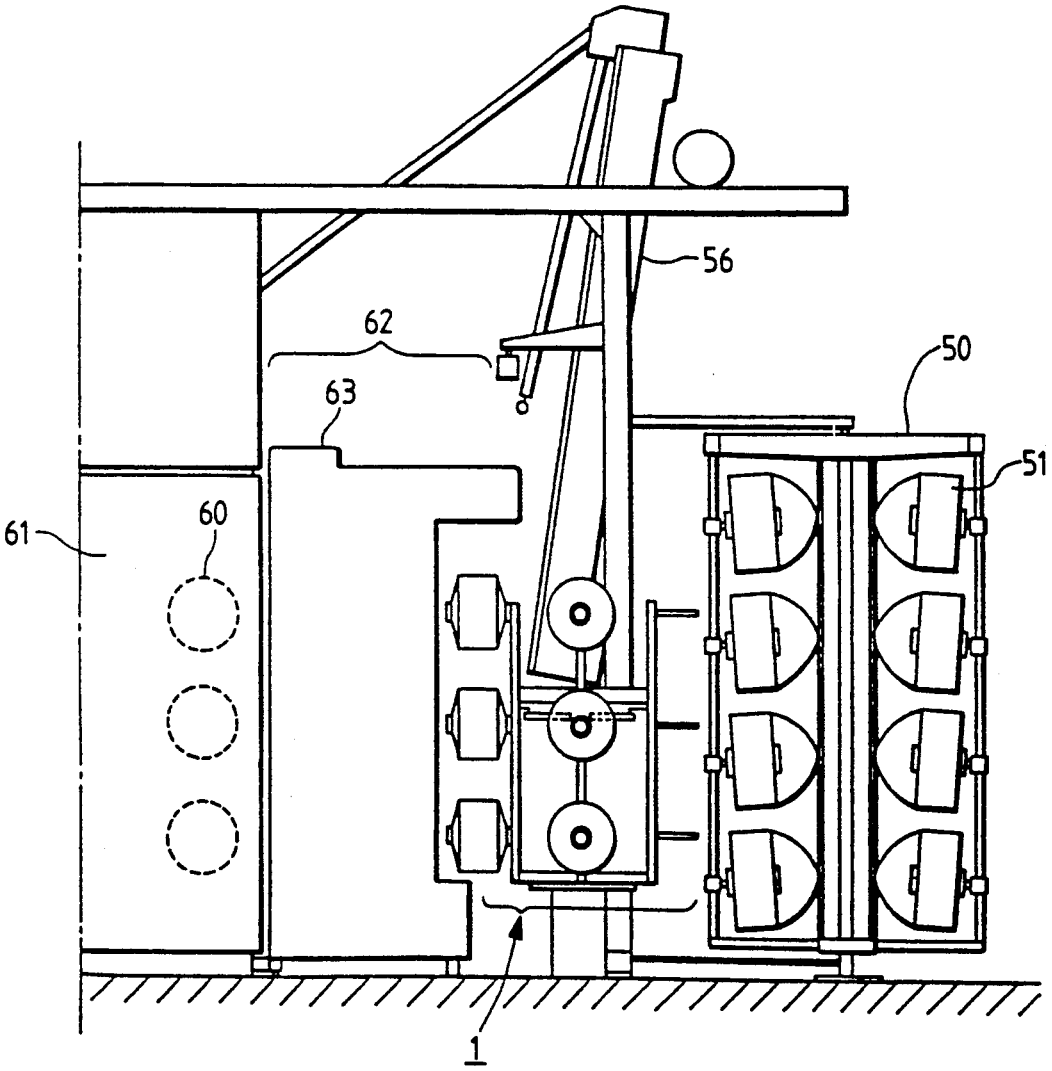
FIG. 2 is a side view of a peg circulator.
Figure 3:
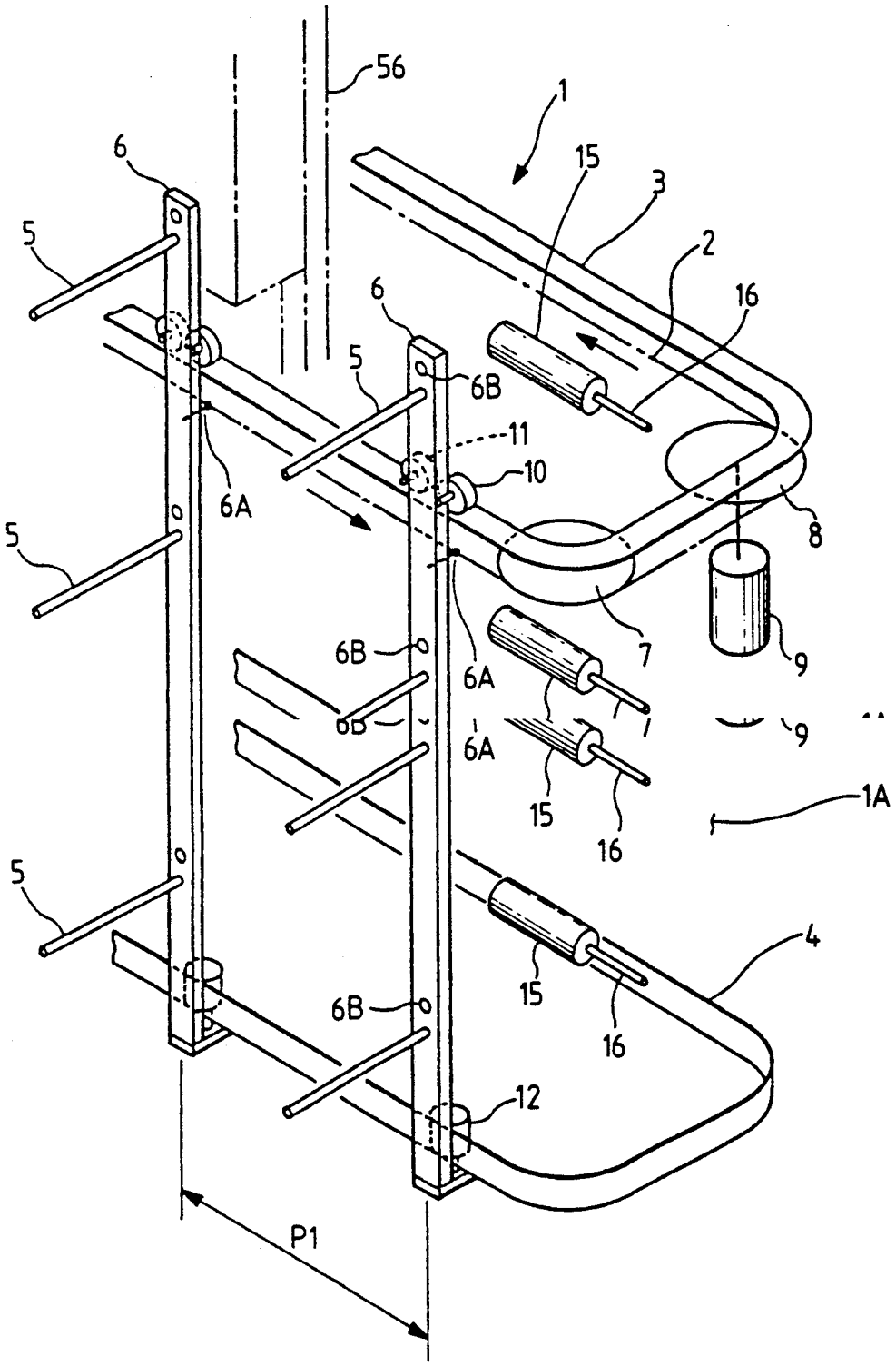
FIG. 3 is a perspective view of the peg circulator.
Figure 4:
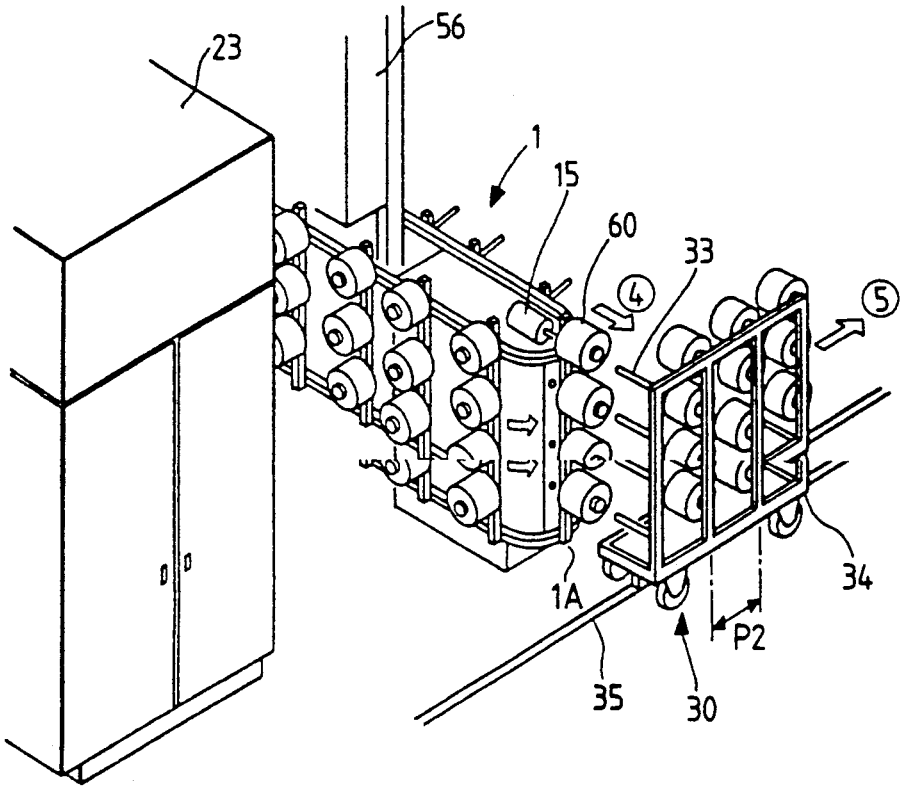
FIGS. 4, 5 and 6 are perspective views of an out-of-the-machine conveying device.
Figure 5:
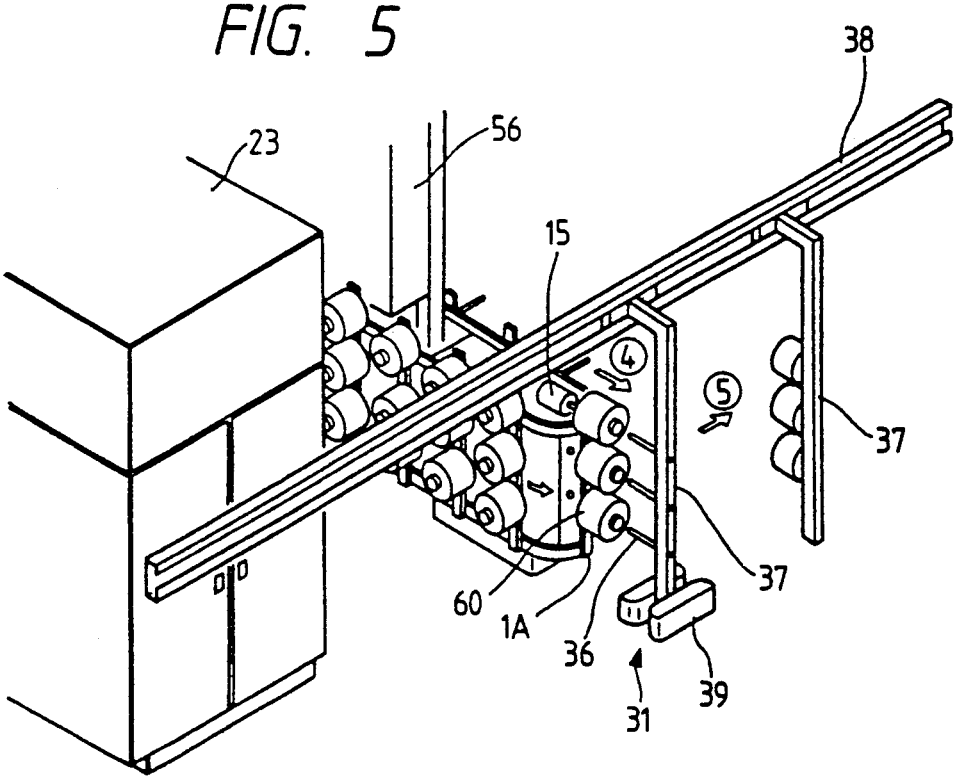
Figure 6:
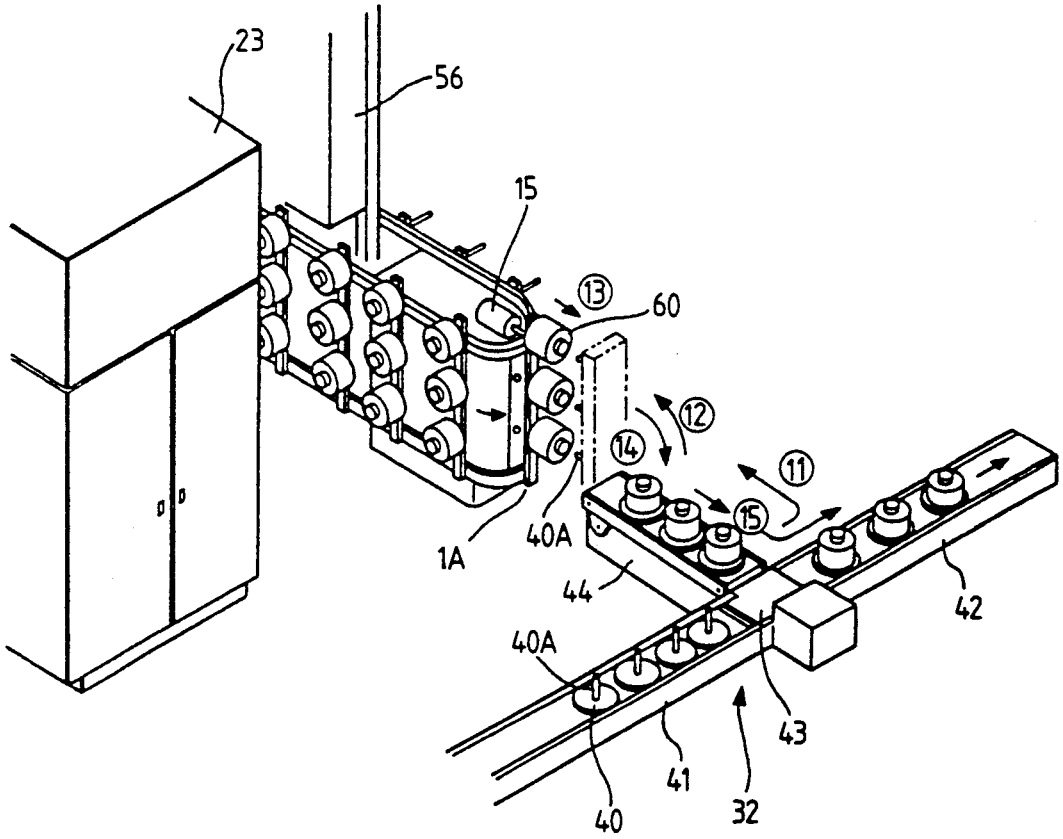
Figure 10:
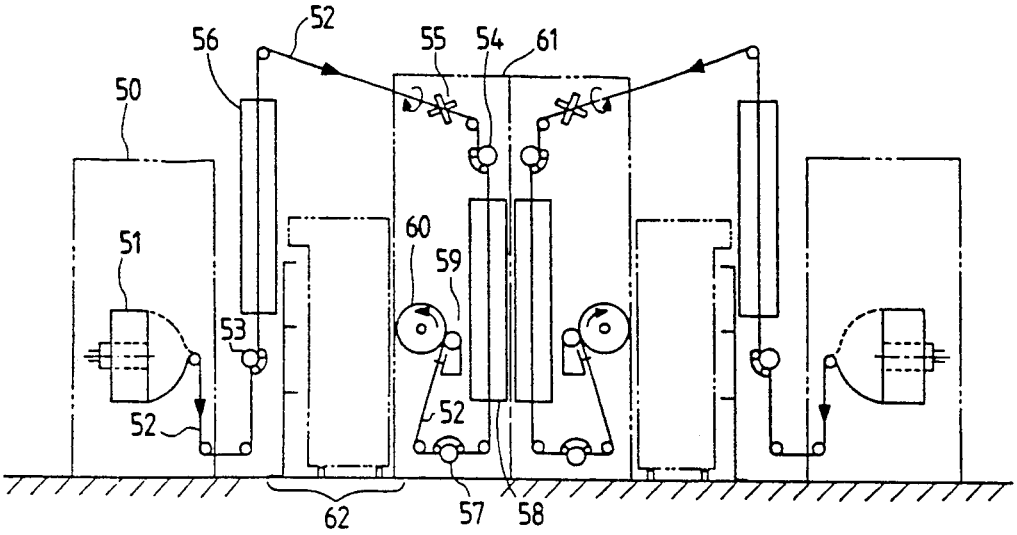
FIG. 10 PRIOR ART
FIG. 10 is a side view of a conventional draw false twisting machine.
Figure 11:
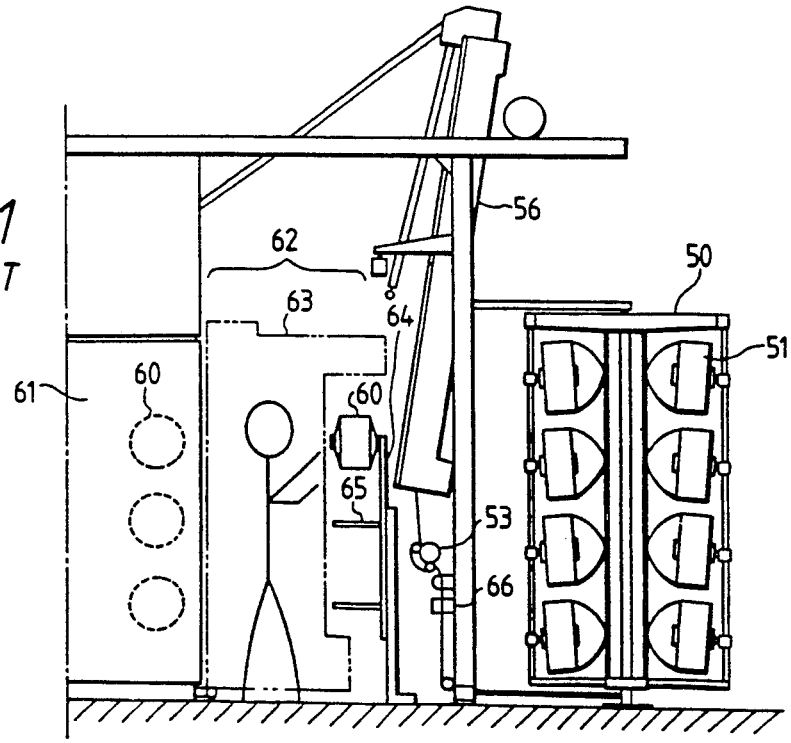
FIG. 11 PRIOR ART
FIG. 11 is a side view for describing a package conveyance method for the conventional draw false twisting machine.

An embodiment of the present invention is hereafter described with reference to the drawings attached hereto. FIG. 1 is a plan view for describing a method in which a package is conveyed from a draw false twisting machine. FIG. 2 is a side view of a peg circulator. FIG. 3 is a perspective view of the peg circulator. FIGS. 4, 5 and 6 are perspective views of an out-of-the-machine conveying device. Portions shown in FIGS. 1, 2, 3, 4, 5 and 6 and equivalent to those shown in FIGS. 10 and 11 are denoted by the same reference symbols as the latter and not described in detail hereinafter.

The package conveyance method includes a step in which the package is transferred onto a peg by an automatic doffer 63 shown in FIG. 1, a step in which the package is conveyed to an end section by the peg circulator 1, and a step in which the package is pushed out from the peg onto the out-of-the-machine conveying device 30 by a pusher 15. FIG. 1 also shows primary heater blocks 20, each of which is for twelve packages, body blocks 21, each of which is for twelve packages, control end sections 22, and drive end sections 23.

The steps of the method are described along with the constitution and operation of the equipment from now on. The function of the automatic doffer 63 for the transfer step is the same as that described for the conventional method. The automatic doffer 63 performs doffing for every block, and transfers the packages 60 onto pegs 5 sequentially, as shown at (1) in the upper half of FIG. 1, and moves in a path 62, as shown at (2) therein. When all the packages 60 are transferred onto the pegs 5, taking the transfer step is completed. The difference of the transfer step from that of the conventional method is that the package 60 is transferred not onto the peg of the peg stand but onto the peg 5 of the peg circulator 1.

The peg circulator 1 is intermediately revolved clockwise as shown at 3 in the lower half of FIG. 1, so that the package 60 is conveyed to the end section 1A of the peg circulator. The peg circulator 1, which is revolved around primary heaters 56 shown in FIG. 2, is provided for the conveyance step.

The peg circulator 1 is described in detail with reference to FIG. 3 from now on. An endless chain 2, an upper guide rail 3 and a lower guide rail 4 are provided around the primary heaters 56. Vertical plates 6, from each of which three pegs 5 project, are attached to the chain 2 at joints 6A so that the pegs are coupled to the chain through the vertical plates. The vertical plates 6 are attached to the endless chain 2 at not more than about a half of the length thereof and not attached thereto at the other of the length (Refer to the upper half of FIG. 3). The endless chain 2 forms a revolution orbit around sprockets 7 and 8, and is revolved by a drive motor 9. Roller followers 10 and 11, which are moved on the upper guide rail 3, and roller followers 12, which are moved on the lower guide rail 4 in such a manner that the lower guide rail is interposed between the roller followers and the vertical plates 6, are secured to the vertical plates. In the peg circulator 1 having the above-described constitution, the pegs 5 are revolved around the primary heaters 56 by the rotating motor 9 as the pegs remain at a horizontal pitch P1 between them, so that the packages 60 are sequentially conveyed to the end section 1A. When the step of the conveyance of the packages 60 is completed, the pegs 5 of the peg circulator 1 are all located between the primary heater blocks 20 and creel stands 50. In that state, yarn engagement work is performed. Besides, only the guide rails 3 and 4 and the chain 2, which are shown in FIG. 3, are left in the path 62 with regard to the peg circulator 1 in that state so that there is an opening at the guide rails and the chain. For that reason, the yarn engagement work to first feed rollers 53 shown in FIG. 10 or the like can be efficiently performed. The pegs 5 should be coupled to the chain 2 at not more than a half of the length thereof so that the pegs are not located in the path 62 at the end of the above-mentioned revolution of the chain. After the yarn engagement work is performed, the pegs 5 are moved back to the original state shown in the upper half of FIG. 1. Although the peg circulator 1 is made of the drive means constituted by the chain, the circulator may be made of rope or the like. Besides, various conventional coupling and driving means may be adopted as means for coupling the pegs to the endless drive means, and as the guide rails.

The push-out step of the method is described from now on. When the package 60 is moved to the end section 1A as shown in the lower half of FIG. 1, the pusher 15 is put into action to push out the package to the out-of-the-machine conveying device 30 as shown at (4) in FIG. 1. After the conveying device 30 is thus filled with the packages 60, the conveyor is moved, as shown at (5) in FIG. 1, to an inspection and packing chamber or the like, which is not shown in the drawings, and a following empty out-of-the-machine conveying device 30 is located at the end section 1A. The pushers 15 are made of pneumatic cylinders constituting vertical threesome. When the vertical plate 6 holding the packages 60 is located at the end section 1A, the piston rods 16 of the cylinders are protruded through the holes 6B of the vertical plate to push the ends of the bobbins of the packages engaged on the pegs 5.

The out-of-the-machine conveying device 30, which receives the packages 60 from the peg circulator 1, has pegs or trays, and is described in detail with reference to the drawings. FIG. 4 shows the conveying device 30 which has the pegs and is of the truck type. In the conveying device 30 shown in FIG. 4, the pegs 33 constitute three vertical threesome and project from a truck 34 which can perform controlled movement on a guide rail 35. The truck 34 is stopped in a position wherein the empty pegs 33 are opposed to the end section 1A and receive the packages 60 pushed out by the pushers 15. The truck 34 is thereafter moved by a pitch P2 so that the next empty pegs 33 are opposed to the end section 1A. After the truck 34 is filled with the packages 60, the truck is moved away from the end section 1A and a next empty truck is stopped at the end section.

FIG. 5 shows an out-of-the-machine conveying device 31 which has pegs and is of the overhead type. The conveying device 31 may be provided instead of the conveying device 30. In the conveying device 31, a hanger 37 having a vertical threesome of the pegs 36 can perform controlled movement while being guided by an overhead rail 38. The empty hanger 37 is stopped in a position wherein it is opposed to the end section 1A and positioned by guides 39 and receives the packages 60 pushed out by the pushers 15. The hanger 37 filled with the packages 60 is moved away from the position, and a next empty hanger 37 is stopped in the position.

FIG. 6 shows an out-of-the-machine conveying device 32 which has the trays and is of the tray type. The conveying device 32 may be provided instead of the conveying device 30. The conveying device 32 includes a first conveyance unit 41 for conveying empty trays 40, a second conveyance unit 42 for conveying trays bearing the packages, a turning conveyance unit 43, and a tilting conveyance unit 44. The empty trays 40 are conveyed from the first conveyance unit 41 onto the tilting conveyance unit 44 by way of the turning conveyance unit 43 as shown at ⑪ in FIG. 6. The trays on the tilting conveyance unit are secured in prescribed positions by positioning holders not shown in FIG. 6. The tilting conveyance unit 44 is then tilted by an angle of 90 degrees as shown at ⑪ in FIG. 6, so that the shafts 40A of the trays are opposed to the packages in the end section 1A. The tilting conveyance unit 44 then receives the packages 60 pushed out by the pushers 15, as shown at ⑬ in FIG. 6, and is thereafter returned to the original horizontal position thereof as shown at ⑭ in FIG. 6. The trays 40 bearing the packages 60 are then released and conveyed from the tilting conveyance unit 44 onto the second conveyance unit 42 by way of the turning conveyance unit 43 as shown at ⑮ in FIG. 6. These actions shown at ⑪, ⑫, ⑬, ⑭ and ⑮ are repeatedly formed to receive and convey every three packages 60. Since a procedure of conveyance with the use of such trays is convenient for conveyance, securing and so forth in insepction and packing, the procedure is a preferable one.

In a package conveyance method provided in accordance with the present invention, an automatic doffer movable between the body and primary heaters of an elongation false twisting machine doffs packages from the body and transfers the packages onto pegs coupled to an endless drive means revolvable around the primary heaters. The endless drive means is then revolved so that the packages are conveyed to an end section. Pushers provided at the end section push out the packages to an out-of-the-machine conveying device having trays or pegs. The step of the conveyance of the packages by the pegs coupled to the endless drive means revolvable around the primary heaters and the step of the pushing-out of the packages at the end section are kinematically connected with each other so that the packages are efficiently delivered to the out-of-the-machine conveying device. For that reason, the time which it takes to convey out the packages from the machine is much shortened, and the production efficiency of the machine is enhanced. Since the endless drive around the primary heaters is designed to leave maintenance space and the pushers provided at the end section are used in the method, the method can be practiced similarly to the conventional method with regard to the size of the entire installation space of the machine.

Figure 7:
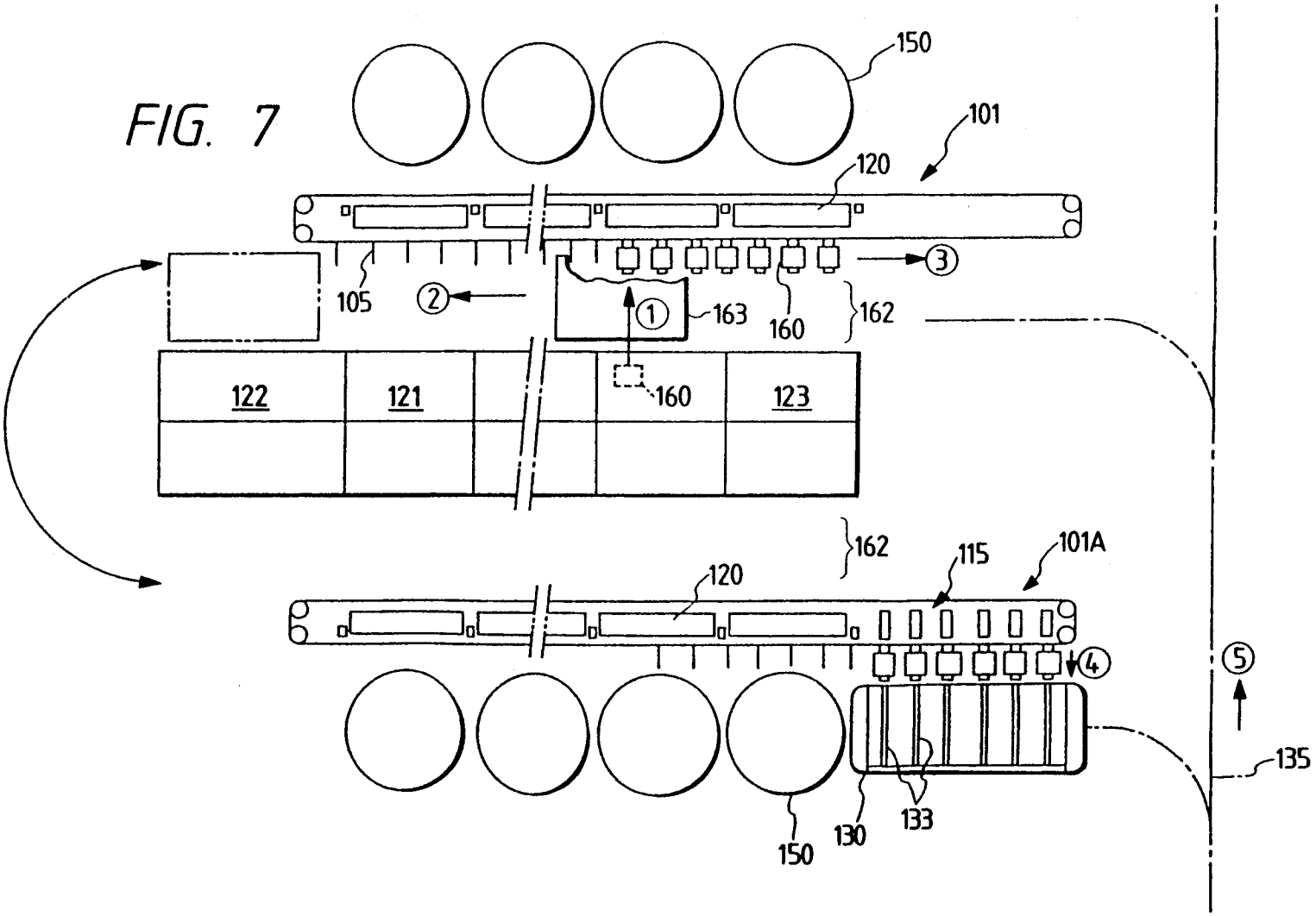
FIG. 7 is a plan view for describing a method in which a package is conveyed from an elongation false twisting machine and which is an other embodiment.
Figure 8:
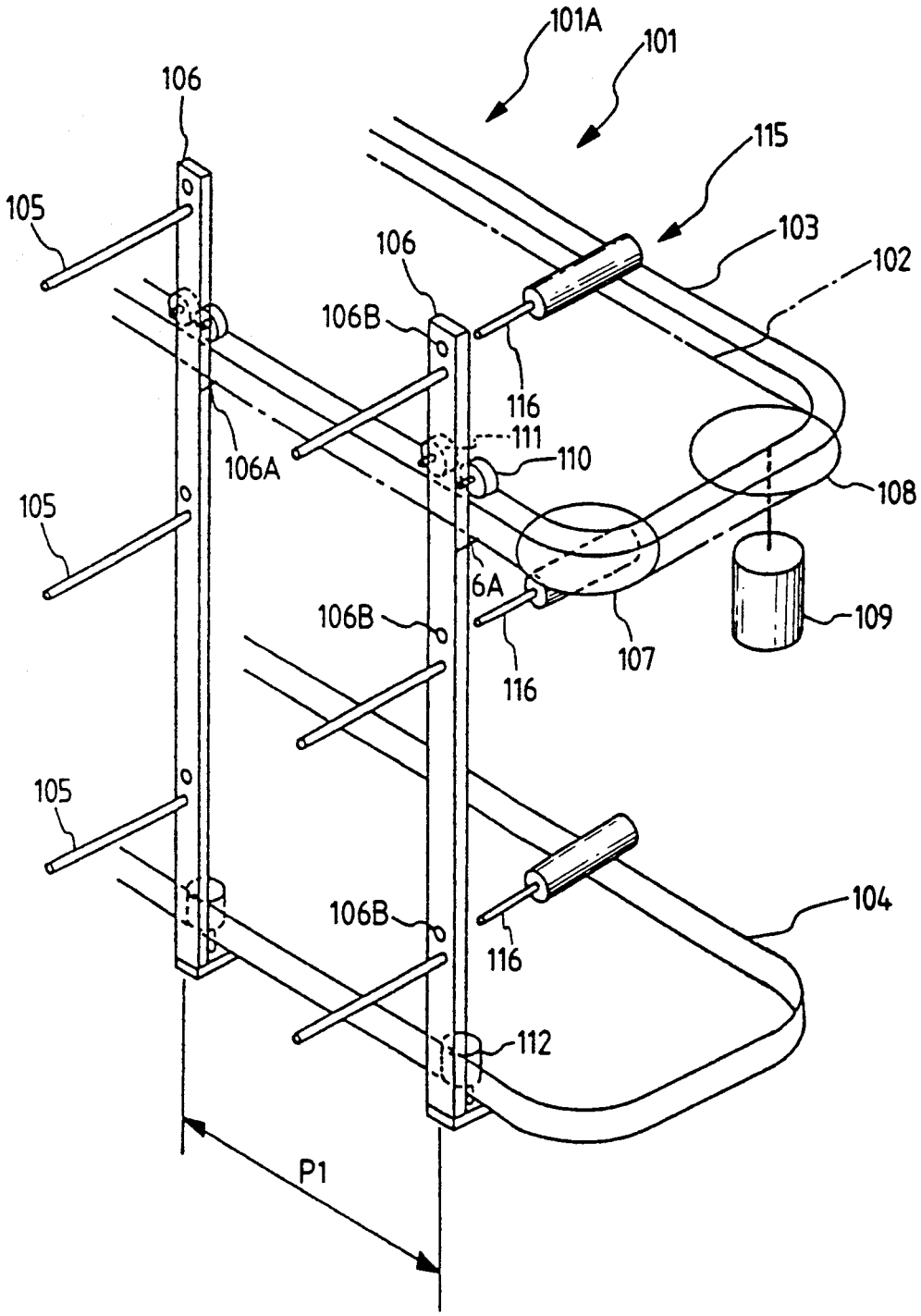
FIG. 8 is a perspective view of a peg circulator 101 shown in FIG. 7.

Another embodiment of the present invention is hereafter described with the drawings attached hereto. FIG. 7 is a plan view for describing a method which is the embodiment and in which a package is conveyed from an elongation false twisting machine. FIG. 8 is a perspective view of a peg circulator.

The package conveyance method includes a step in which the package is transferred onto a peg by an automatic doffer 163 shown in FIG. 7, a step in which the package is conveyed to an end section by the peg circulator 101, and a step in which the package is pushed out onto an out-of-the-machine conveying device 130 by a pusher 115. FIG. 7 also shows primary heater blocks 120, each of which is for twelve packages, body blocks 121, each of which is for twelve packages, control end sections 122, and drive end sections 123.

The steps of the method are described along with the constitution and operation of the equipment. The function of the automatic doffer 163 for the step of the transfer is the same as that described for the conventional method. The automatic doffer 163 doffs the packages from each block and sequentially transfers the packages onto the pegs 105 as shown at ① in the upper half of FIG. 7. The automatic doffer 163 is moved in a path 162 as shown at ② in the upper half of FIG. 7. When the packages 160 are all transferred onto the pegs 105, taking the transfer step is completed.

The conveyance step of the method is described from now on. The peg circulator 101 is intermittently driven so that the circulator is revolved clockwise as shown at ③ in the lower half of FIG. 7. The packages 160 are thus conveyed to the end section 101A of the peg circulator 101. As shown in FIG. 8, an endless chain 102 constituting an endless drive means, an upper guide rail 103 and a lower guide rail 104 are provided around the primary heater blocks 120. Vertical plates 106, each of which three pegs 105 project, are attached with joints 106A to the chain 102. The pegs 105 are thus coupled with the vertical plates 106 to the endless chain 102 constituting the endless drive means. The vertical plates 106 are attached to the endless chain 102 at not more than about a half of the length thereof, and not attached thereto at the other of the length. The endless chain 102 forms a revolution orbit around sprockets 107 and 108, and is revolved by a drive motor 109. Roller followers 110, which are moved on the upper guide rail 103, and roller followers 112, which are moved in such a manner that the lower guide rail 104 is interposed between the roller followers 112 and the vertical plates 106, are secured to the vertical plates. In the peg circulator 101 having the above-described constitution, the pegs 105 are revolved around the primary heater blocks 120 by the rotating motor 109 are revolved around the primary heater blocks 120 by the rotating motor 109 as the pegs remain at a pitch P1 between them, so that the packages are sequentially conveyed to the end section 1A. When the conveyance step is completed, the pegs 105 of the peg circulator 101 are all located between the primary heater blocks 120 and creel stands 150. In that state, yarn engagement work is performed. Only the guide rails 103 and 104 and the chain 102, which are shown in FIG. 8, are left in the path 162 with regard to the peg circulator 101, so that there is an opening at the guide rails and the chain.

The pushing-out step of the method is described from now on. When the package 160 is moved to the end section 1A as shown in FIG. 7, the pusher 115 is put into action so that the package is pushed out onto an unmanned conveyance vehicle 130 as shown at ④ in FIG. 7. After the vehicle 130 is filled with the packages, the vehicle is moved, as shown at ⑤ in FIG. 7, to an inspection and packing chamber or the like, which is not shown in the drawings. As shown in FIGS. 7 and 8, the pushers 115 are made of pneumatic cylinders constituting six vertical threesome juxtaposed horizontally. When the vertical plate 106 bearing the packages 160 are located at the end section 101A, the piston rods 116 of the pneumatic cylinders are protruded through the holes 106B of the vertical plate 106 so that the ends of the bobbins of the packages are pushed. Since the pegs 105 on the vertical plates 106 correspond to pegs 133 on the unmanned conveyance vehicle 130, the packages 160 are simultaneously transferred onto the pegs 133 on the vehicle when the piston rods of the pneumatic cylinders constituting the six vertical threesome are simultaneously protruded. After that, the peg circulator 101 is revolved by a length six times larger than the pitch P1 to deliver other packages 160 to a place in front of the unmanned conveyance vehicle 130 to transfer the packages onto the vehicle by the pushers 115. Such transfer is performed repeatedly to fill the vehicle with the packages. The vehicle 130 is then moved to the inspection and packing chamber or the like, in which the packages is subjected to anterior processing.

The unmanned conveyance vehicle 130 is provided with the pegs 133 projecting from the vehicle and constituting six vertical threesomes juxtaposed horizontally, and can perform controlled movement along a guide line 135. In a position wherein the empty pegs 133 are opposed to the end section 101A, the conveyance vehicle 130 is stopped by a positioning means such as a positioning cylinder and receives the packages 160 pushed out by the pushers 115.

It will be understood from the above description that in a package conveyance method provided in accordance with the present invention, the time which it takes to convey out packages is considerably shortened, and the production efficiency of a machine is enhanced.

Figure 9:
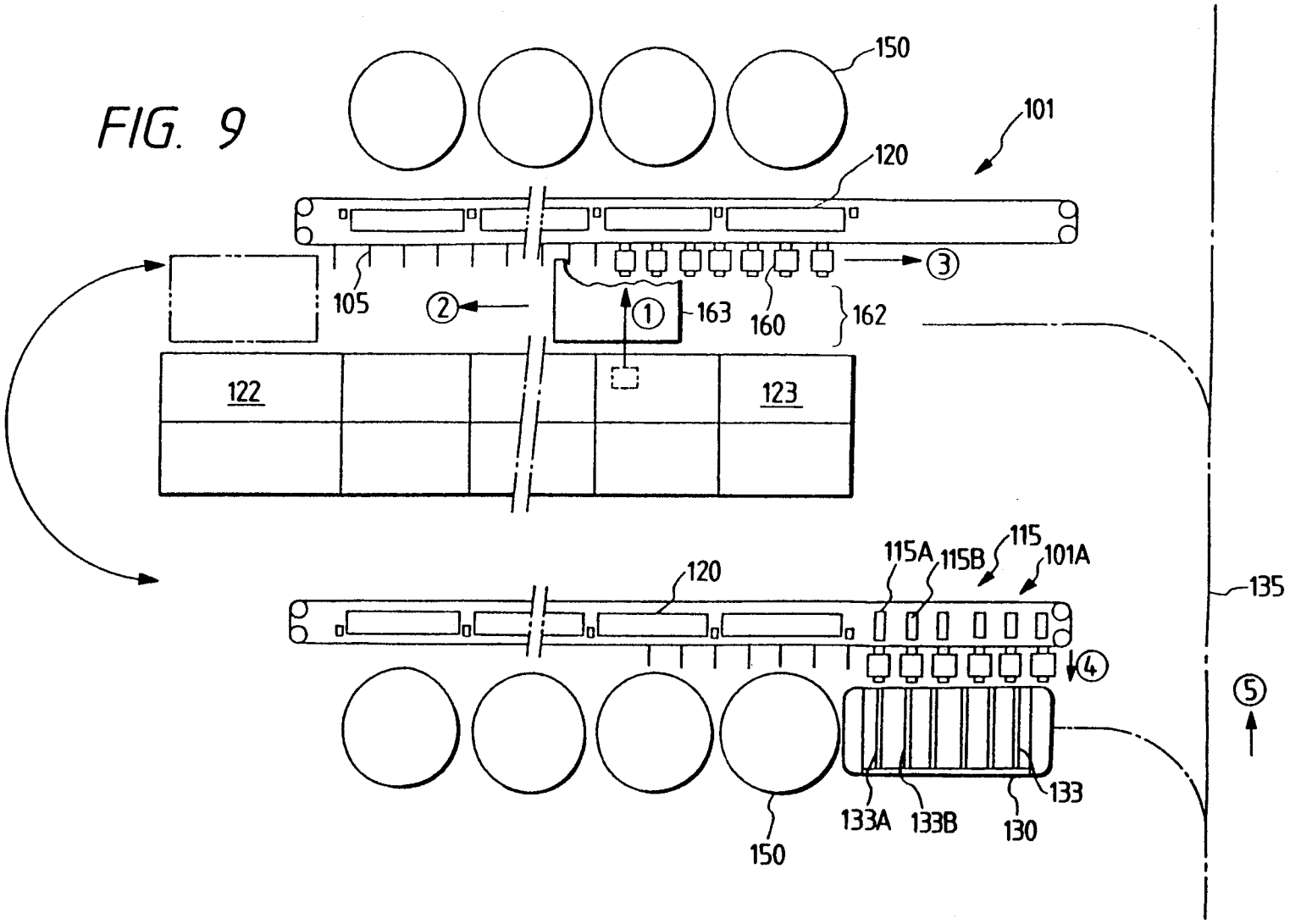
FIG. 9 is a plan view for describing yet still another embodiment of the present invention.

Yet another embodiment of the present invention is hereafter described with reference to the drawing attached hereto. FIG. 9 is a plan view for describing a method which is the embodiment and in which a package is conveyed from a draw false twisting machine. The method is the same as the preceding once except for an unmanned conveyance vehicle 130. The pitch between pegs 105 on vertical plates 106 differs from that between the pegs 133 of the vehicle 130. The packages 160 are transferred onto the vehicle 130 by actions dependent on the difference and described from now on. The difference is for enhancing the efficiency of loading on the vehicle 130 when the diameter of the package is small. To transfer the packages onto the unmanned conveyance vehicle 130, the pushers 115A, which are some of pushers 115 and nearest a creel stand 150, and the pegs 133A of the vehicle are positioned to each other. The packages 160 constituting a vertical threesome are then transferred on to the vehicle 130. After that, a package circulator 101 is revolved by a pitch P1 to transfer the other packages onto the vehicle 130. When such operation is repeated, the pegs 133A of the vehicle are all filled with the packages. After that, the other pushers 115B and the other pegs 113B are positioned to each other and the operation is repeated. After all the pegs 133 of the vehicle 130 are filled with the packages by the transfer, the vehicle is moved to an inspection and packing chamber or the like, in which the packages are subjected to posterior processing.

The unmanned conveyance vehicle 130 shown in FIG. 9 is provided with the pegs 133 projecting from the vehicle and constituting six vertical threesomes juxtaposed horizontally, and can perform controlled movement along a guide line 135. In a position wherein the empty pegs 133 are opposed to an end section 101A, the vehicle 130 is stopped by a positioning means such as a positioning cylinder and receives the packages 160 pushed out by the pushers 115.

Although the pushers 115A, 115B, . . . and the pegs 133A, 133B, . . . of the unmanned conveyance vehicle 130 are positioned to each other by moving the package circulator 101, the same effect is produced even if the positioning is performed by moving the vehicle.

Since the packages 160 can be efficiently loaded on the unmanned conveyance vehicle 130, the vehicle can be made compact.

It will be understood from the above description that in a package conveyance method provided in accordance with the present invention, the time which it takes to convey out packages is considerably shortened, and the production efficiency of a machine is enhanced.

In a package conveyor provided in accordance with the present invention, for an elongation false twisting machine in which primary heaters are disposed to face the body of the machine across a path and an automatic doffer is movably disposed in the path, a large number of pegs for bearing packages delivered from the automatic doffer are coupled to about half the overall length or less of an endless drive means, which is revolved around the primary heaters. The endless drive means receives the packages from the automatic doffer so that the packages are borne by the pegs. The pegs are revolved so that the packages are conveyed out of the elongation false twisting machine. After the packages are conveyed out of the machine, the pegs are located opposite the path so that the pegs are not present in the path when yarn engagement work is performed. For that reason, enhanced efficiency of the yarn engagement work and automatic conveying-out of the packages are obtained.

What is claimed is:

1. A package conveying apparatus for use with a false twisting machine and a plurality of heaters, the plurality of heaters being disposed such that an automatic doffer is movable between the plurality of heaters and the false twisting machine, the package conveying apparatus comprising:

an endless drive device surrounding the plurality of heaters, the endless drive device defining a circumference, a plurality of pegs for carrying a plurality of packages delivered from the false twisting machine by the automatic doffer, and a plurality of support devices associated with a predetermined portion of the endless drive device, each support device adapted to support at least one of the pegs, the plurality of support devices defining a support device group having a length which is substantially less than approximately one half of the circumference of the endless drive device.

2. A package conveying apparatus according to claim 1, wherein the endless drive device comprises a rope.

3. A package conveying apparatus as claimed in claim 1 wherein the endless drive device comprises a chain, each support device comprises a plate coupled with the chain and a predetermined plurality of pegs project from the plate, the apparatus further including an upper guide rail and a lower guide rail for movably supporting the plates.

4. A package conveying apparatus as claimed in claim 3 including first and second rollers movably secured to each of the plates for movably engaging the upper and lower guide rails, respectively.

5. A package conveying apparatus as claimed in claim 4 including a delivery device having a plurality of at least one of trays and pegs, the delivery device being opposingly arranged with a portion of the endless drive device, and wherein the apparatus includes a pushing means for pushing packages from the plurality of pegs onto the plurality of at least one of trays and pegs of the delivery device.

6. A package conveying apparatus as claimed in claim 5, wherein the pushing means includes a pneumatic cylinder having a piston rod, the piston rod protruding through a hole of at least one of the plates to push an end of a package engaged on a peg projecting from the at least one plate.

7. A package conveying apparatus as claimed in claim 6, wherein the delivery device is a truck type deliver device including a guide rail and a truck which travels along the guide rail, the truck including a plurality of pegs projecting therefrom for conveying packages.

* * * * *